US005449274A

United States Patent [19]

Kochan, Jr.

[11] Patent Number: 5,449,274

[45] Date of Patent: Sep. 12, 1995

[54] SUMP SYSTEM HAVING TIMED SWITCHING OF PLURAL PUMPS

[75] Inventor: John Kochan, Jr., Naperville, Ill.

[73] Assignee: Metropolitan Pump Company, Romeoville, Ill.

[21] Appl. No.: 217,420

[22] Filed: Mar. 24, 1994

[51] Int. Cl.[6] ..... F04B 41/06; F04B 49/025

[52] U.S. Cl. ..... 417/8; 417/12; 417/41

[58] Field of Search ..... 417/2, 7, 8, 12, 36, 417/40, 41

[56] References Cited

U.S. PATENT DOCUMENTS

| | | | |
|---|---|---|---|
| 3,741,683 | 6/1973 | McTamaney et al. | 417/7 |
| 3,744,932 | 7/1973 | Prevett | 417/7 |
| 4,341,983 | 7/1982 | Gottliebson | 417/7 |
| 4,437,811 | 3/1984 | Iwata et al. | 417/40 |
| 4,444,545 | 4/1984 | Sanders et al. | 417/40 |
| 4,551,068 | 11/1985 | Boudreaux | 417/36 |
| 5,343,384 | 8/1994 | Fisher et al. | 417/8 |

*Primary Examiner*—Richard A. Bertsch
*Assistant Examiner*—Roland G. McAndrews, Jr.
*Attorney, Agent, or Firm*—Dressler, Goldsmith, Shore & Milnamow, Ltd.

[57] ABSTRACT

An electronic pump selector system uses a programmable processor to select one of a plurality of pumps to be energized in response to an appropriate feedback signal from the selected pump. A current limited feedback circuit is incorporated which provides a varying voltage in response to a level switch associated with a selected pump indicating a high fluid level. In response to the voltage feedback signal, the selected pump is energized for a predetermined period of time. Subsequently, another pump is selected. The next selected pump is energized also for a predetermined period of time in response to a varying voltage feedback signal therefrom. The next pump is then selected and the sequence continued.

12 Claims, 3 Drawing Sheets

SUMP SYSTEM HAVING TIMED SWITCHING OF PLURAL PUMPS

FIELD OF THE INVENTION

The invention pertains to systems and methods of selecting one of a plurality of pumps to be energized. More particularly, the invention pertains to a system of alternately selecting one of two pumps to be energized.

BACKGROUND OF THE INVENTION

There are numerous applications where it is desirable to use two or more pumps on a cyclical basis for maintaining the level of fluid in a sump or a tank. The use of multiple pumps increases overall system reliability and extends the time period during which any one pump may be kept in service.

Prior products are known for the purpose of cyclically energizing the members of a group of pumps. One common use involves pump alternator circuitry in combination with two pumps for maintaining the level of fluid in a sump or a tank.

Such systems usually require some form of feedback so as to determine when to energize a selected pump. At times, feedback is also used to determine when to terminate energizing of that pump.

Some of the known pump alternator systems use current sensors in the feedback path to determine when a pump should be energized. Such sensors tend to be more expensive than desired in many types of products.

There thus continues to be a need for cost effective, reliable pump alternator systems. Preferably, such systems would incorporate relatively inexpensive feedback elements and could be expandable to more than two pumps. Also, it would be preferred if standard, off-the-shelf, pumps could be used.

SUMMARY OF THE INVENTION

A pump selector includes a control element coupled by electrically actuated switches to a plurality of pumps. The control element selects the next pump to energize.

Each of the pumps has an associated fluid level responsive on/off switch. A feedback element is coupled between each of the pumps on/off switches and the control element.

Each of the feedback elements establishes a current limited sensing path between a source of electrical energy and a respective pump via the pump on/off switch. When the pump on/off switch goes from an "off" state to an "on" state, the respective current limited sensing path provides an associated voltage feedback signal to the control element.

The control element, in response to the feedback signal, can energize that pump via a respective switch provided that that pump is the selected pump. If not, the control element waits for a feedback signal from the selected pump.

The selected pump is subsequently energized. The control element can energize the selected pump for a predetermined period of time. Alternately, the pump can be energized until the feedback signal is no longer received at the control element.

A separate feedback path can be provided to indicate a "high level" condition in the event one of the pumps fails to function properly when energized. Visual and audible alarms can be energized by the control element when this condition is detected.

The control element can include a programmable processor. The processor can keep a log of when each pump was energized for subsequent analysis. If desired, the pumping time interval can be entered or modified by a keypad or the input device.

These and other aspects and attributes of the present invention will be discussed with reference to the following drawings and accompanying specification.

DETAILED DESCRIPTION OF THE PREFERRED EMBODIMENT

Figure 1:
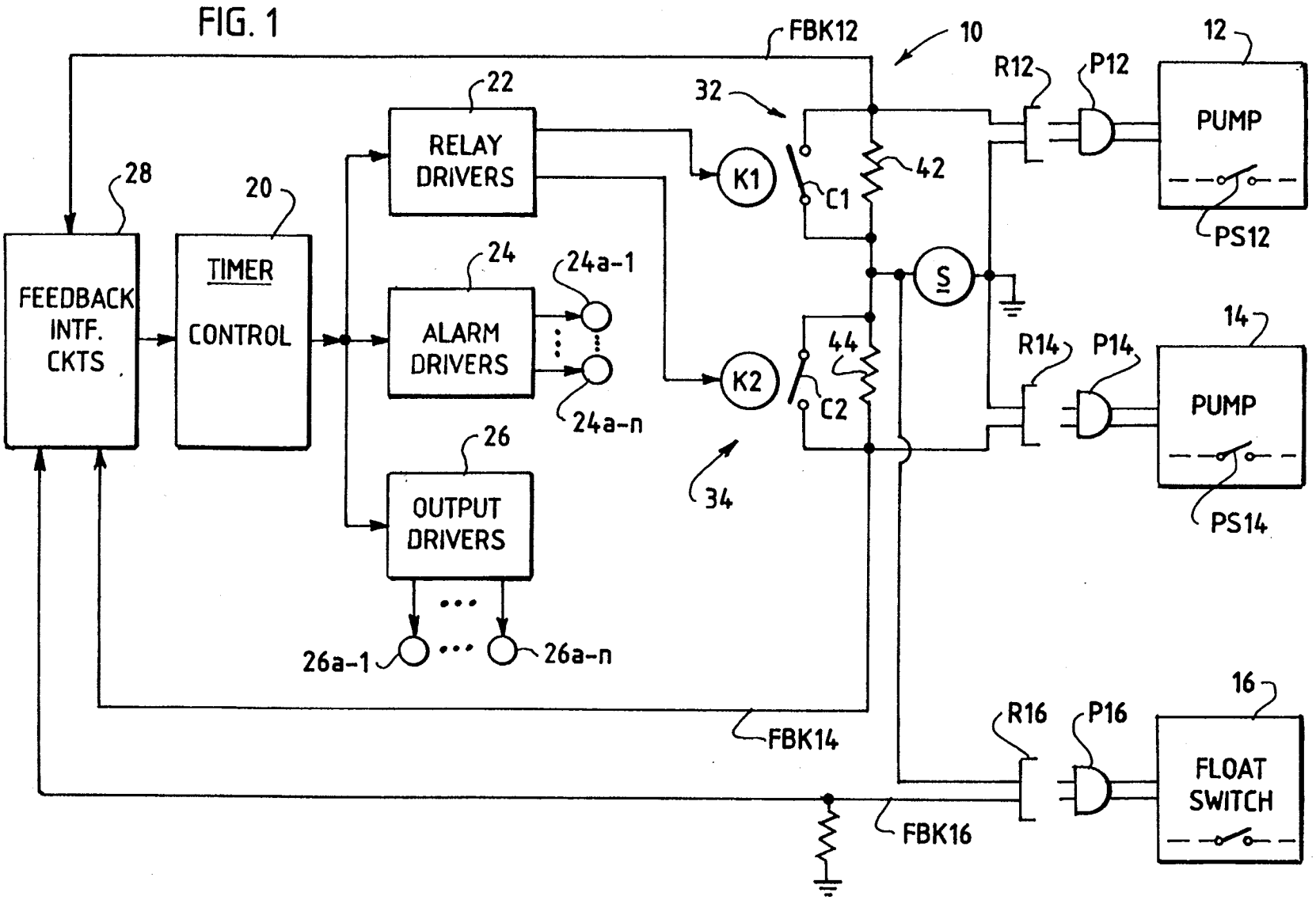
FIG. 1 is a block diagram of a pump selector in accordance with the present invention.

While this invention is susceptible of embodiment in many different forms, there is shown in the drawing, and will be described herein in detail, specific embodiments thereof with the understanding that the present disclosure is to be considered as an exemplification of the principles of the invention and is not intended to limit the invention to the specific embodiments illustrated.

FIG. 1 is a block diagram of a system 10 in accordance with the present invention. The system 10, a pump control system, can be used to control the selection and operation of a plurality of pumps such as a pump 12 and a pump 14.

The pumps 12 and 14 can be, for example, conventional sump pumps which are used to control the level of fluid in a sump or a tank. It will be understood that while two pumps are illustrated, that the invention may be used in systems that have more than two pumps.

One of the advantages of the present invention lies in the fact that the pumps 12 and 14 are standard off-the-shelf pumps that are not modified in any fashion. Hence, they are readily replaced for maintenance purposes. Each of the pumps 12 and 14 contains or has associated therewith a level sensing switch, diagrammatically indicated as PS12 and PS14. Level sensing switches are well known and come in different forms. They may be integral with the pumps or they may be external attachments. The exact form, construction or attachment of the switches for the respective pumps is not a limitation of the present invention.

Each of the pumps 12, 14 is conventionally powered by plugging the respective pump, via a respective plug P12, P14 into a standard AC receptacle. The respective switch PS12 or PS14 then turns the pump on and off depending on the level in the sump or the tank.

The system 10 includes receptacles R12 and R14 which are compatible with plugs P12 and P14 for purposes of coupling to the pumps 12 and 14. The system 10 is powered off of a conventional AC supply S from a utility.

It will be understood that under some circumstances, the system 10 might be powered off of back-up or emergency sources of AC electrical energy. It will also be understood that the system 10 could be used with a source of DC power if the pumps had DC motors. The type of power source is not a limitation of the present invention.

The system 10 includes a control element 20 which can be implemented using a commercially available, programmed, 8 or 16 bit microprocessor. The control element 20 has coupled thereto as outputs, relay driver circuits 22, alarm drivers 24 and visual display drivers 26.

The relay driver circuits 22 are, in turn, coupled to coils K1 and K2 of relays 32 and 34. The alarm driver circuitry 24 is coupled to audible and/or visual alarms 26*a*-1 to 26*a*-n. It will be understood that the exact number of audible and/or visual alarms, as illustrated in FIG. 1, can be varied. Examples of appropriate alarm units includes horns such as the horn 24*a*-2, as well as visual displays 24*a*-1 (see FIG. 3) for purposes of indicating alarm. The visual display circuitry 26 can be coupled to other types of visual displays 26*a*-3 (See FIG. 3) which can indicate status of the system 10 or provide a profile of pump operating history. It will be understood that the number of visual displays 26*a*-1 to 26*a*-n, as illustrated in FIG. 1, can be varied. Neither the number of audible and/or visual alarms 24*a*-1 to 24*a*-n, nor the number of other visual displays 26*a*-1 to 26*a*-n, represent a limitation of the present invention.

The control element 20 receives feedback via a plurality of pump feedback interface circuits 28. For example, one of the feedback signals, FBK12, is associated with pump 12. A second, FBK14, is associate with pump 14.

A third feedback signal, FBK16, is associated with a supplemental float switch 16. The float switch 16 can be coupled to the system 10 via plug P16.

The feedback signals FBK12 through FBK16 in the system 10 are in the form of AC electrical signals when the source S is an AC supply. They are coupled, via the interface circuits 28, to the processor 20.

Associated with each of the relays 32 and 34, is a respective feedback resistor 42 and 44. The resistors 42 and 44 are coupled across respective contacts C1, C2 for the respective relay.

The values of resistors 42, 44 are selected so as to be substantially greater than the impedance values of the respective pumps 12, 14. Values in a range of 12 K–20 K ohms can be used for example.

In normal operation, pumps 12, 14 and float switch 16 are positioned appropriately in the sump or tank where a fluid level is to be controlled. The plugs P12, P14 and P16 are connected to corresponding receptacles R12, R14 and R16 of system 10. The system 10 is energized via the source S.

In this condition, assuming that the pump switches PS12 and PS14 are both open circuited, the feedback signals FBK12 and FBK14 both have peak values corresponding to the peak value of the applied AC voltage from the source S. Additionally, the float switch 16 is open and the high level feedback signal FBK16 will have a value corresponding to 0 volts.

When one of the switches, such as PS12 closes, the corresponding feedback voltage, such as FBK12 drops essentially to zero volts. This provides a signal, via feedback circuits 28 to the control element 20 that the fluid level has increased in the sump or the tank.

If pump 12 is the selected pump, the control element 20 in accordance with its prestored control program, via relay drivers 22 will energize coil K1 of relay 32. This in turn closes contact C1 applying essentially full AC voltage to receptacle R1 and thereby energizing pump 12.

In a preferred embodiment, the control element 20 energizes pump 12 for a predetermined period of time, during which the switch PS12 opens again as the pump reduces the level in the sump of the tank. At the end of the predetermined time interval, relay 32 is deenergized and pump 12 ceases to operate.

Pump 14 is then selected. When the fluid level increases, the control element 20 will receive a feedback signal indicating that switch PS14, of pump 14, has closed due to the feedback signal FBK14 dropping essentially to 0 volts.

Control element 20, via relay drivers 22, then energizes coil K2 of relay 34 for the predetermined period of time. Pump 14 is then energized to pump the fluid level in the sump or the tank down. At the end of the predetermined time control element 20 deenergizes pump 14.

Pump 12 is then again selected. Subsequently, control element 20 detects a drop in the feedback signal FBK1 associated with pump 12 and repeats the above described cycle. Hence, pumps 12 and 14 can be operated alternately. This process is not limited to two pumps.

Float switch 16 provides a high fluid level indicator, via feedback signal FBK16, to the control element 20 in the event that an energized pump fails to function properly. In the event that float switch 16 closes, indicating that fluid level in the sump or the tank has become unacceptably high, control element 20 responding to feedback signal FBK16, can then energize the other of the two pumps for the purpose of reducing the level of fluid in the sump or the tank. In this instance, the other of the pumps is energized until the float switch 38 reopens and for the additional predetermined time interval normally associated with the pumps 12 or 14.

The alarm 24*a* can also be energized to indicate that there has been a failure of one of the pumps. The failed pump can be replaced, and the new pump connected to the system 10 via the respective receptacle R1 or R2.

It will be understood that alternate techniques can be used to control the "on" time interval of the pumps 12 and 14 without departing from the spirit and scope of the present invention. Instead of having a fixed time interval wherein each of the pumps is energized, the respective pump can be energized until the associated switch, such as PS12 or PS14 opens again due to the level in the sump or tank having been reduced by the pump.

Figure 2:
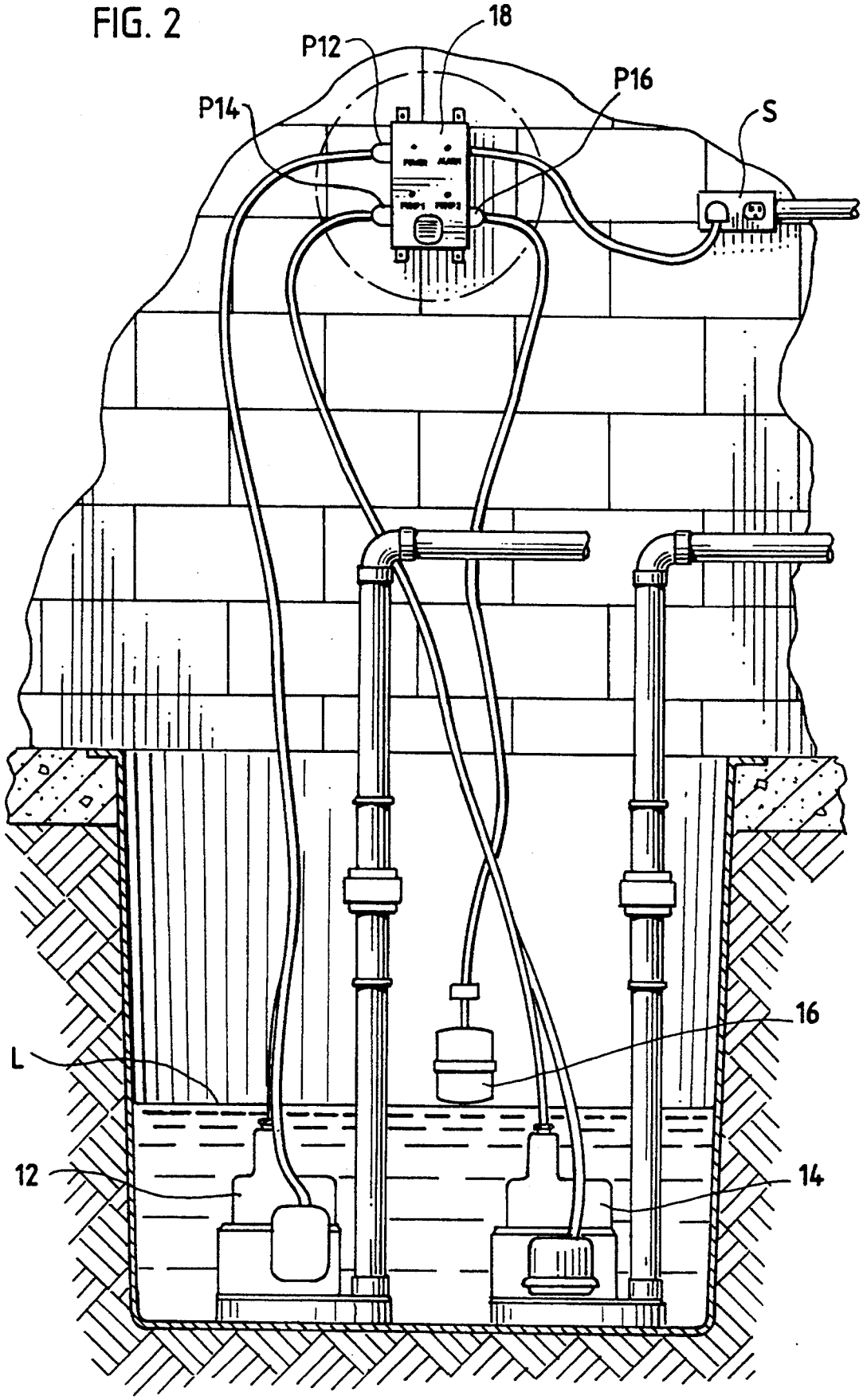
FIG. 2 is a drawing of a two pump alternator system in accordance with the present invention.

FIG. 2 illustrates diagrammatically an installation of the system 10. Pumps 12 and 14 are illustrated positioned in a sump with a fluid level L. Float switch 16 is also positioned in the sump.

Plugs P12 through P16 are coupled to respective receptacles of a housing 18 which contains and supports the previously described components of the system 10. The system 10 can be coupled to an adjacent source of electrical energy S.

Figure 3:
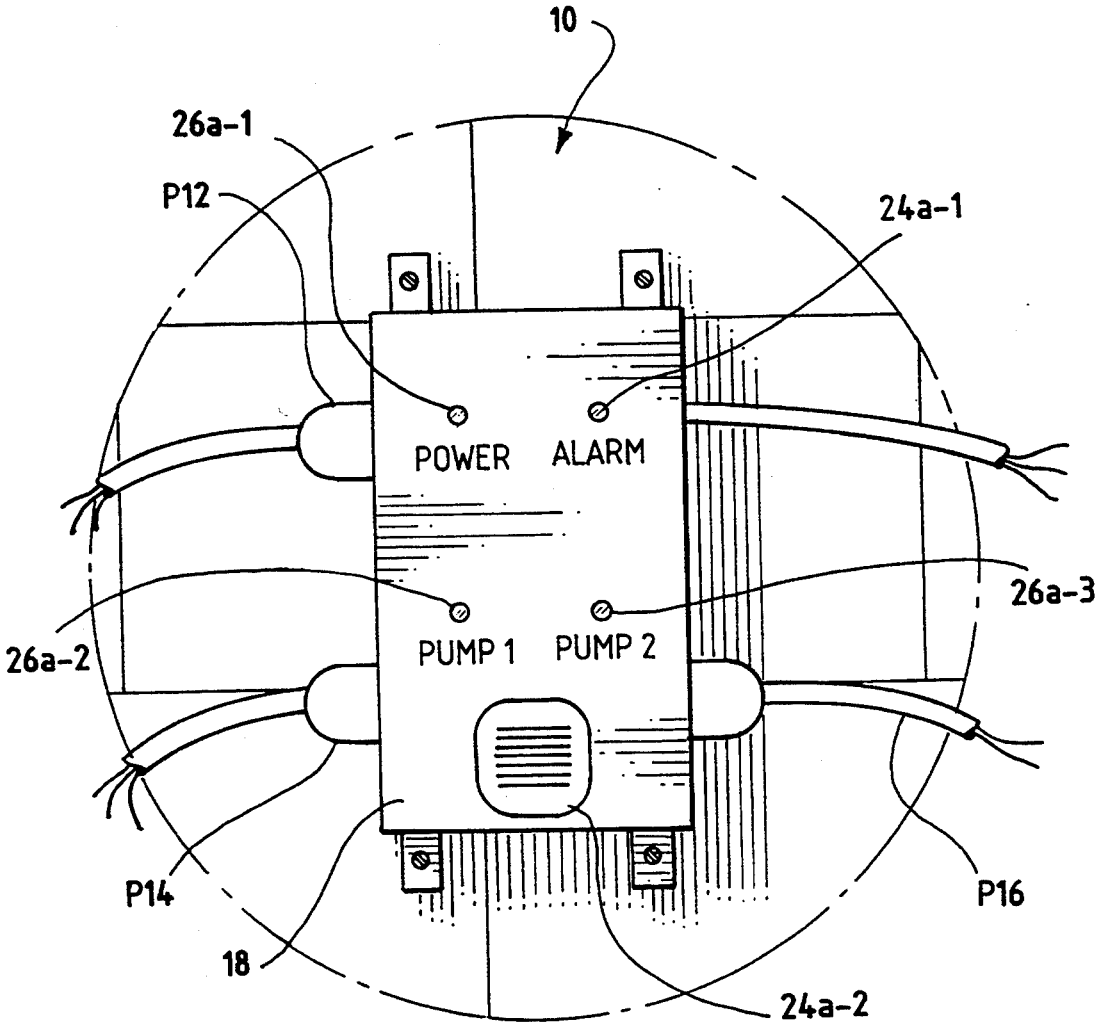
FIG. 3 is an enlarged view of the selector of FIG. 2.

FIG. 3 is an enlarged view of the housing 18 illustrating an alarm display light 24*a*-1 as well as an alarm horn or enunciator 24*a*-2. An additional visual display 26*a*-1 indicates that power has been applied to the unit. Displays 26*a*-2 and 26*a*-3 are alternately lit to indicate when the respective pump 12 or 14 is being energized. It will be understood that other displays or outputs could be provided without departing from the spirit or scope of the present invention.

From the foregoing, it will be observed that numerous variations and modifications may be effected without departing from the spirit and scope of the invention. It is to be understood that no limitation with respect to the specification apparatus illustrated herein is intended or should be inferred. It is, of course, intended to cover by the appended claims all such modifications as fall within the scope of the claims.

What is claimed is:

1. A pump selector usable with at least first and second pumps, each of which includes a level switch with first and second states, the selector comprising:

a first circuit for supplying a first monitoring signal associated with the first pump;

a second circuit for supplying a second monitoring signal associated with the second pump;

circuitry, coupled to said first and second circuits, for detecting a monitoring signal variation responsive to the level switch of at least one of the pumps changing state; and pump selector circuitry coupled to said detecting circuitry, for enabling one and then the other of the pumps to be energized wherein the enabled pump is energized for a predetermined, fixed, time interval after the switch of that pump has changed state.

2. A selector as in claim 1 wherein said pump selector circuitry includes a programmed processor.

3. A selector as in claim 1 wherein said detecting circuitry includes current limiting circuitry for detecting a voltage drop responsive to a pump switch changing state.

4. A selector as in claim 1 which includes circuitry for energizing both pumps in response to a predetermined condition.

5. A selector as in claim 1 wherein said selector circuitry includes a timer for establishing a pump energizing time interval.

6. A selector as in claim 1 wherein said first and second supplying circuits include at least one element for supplying a current limited AC feedback signal.

7. A method of alternately energizing first and second pumps wherein a first ambient condition detecting switch is associated with the first pump and a second ambient condition detecting switch is associated with the second pump, the method comprising:

providing a preset time interval during which a pump is to be energized;

selecting a pump to be energized;

providing first and second current limited signals respectively to the first and second switches;

establishing first and second indicator voltages associated respectively with the first and second current limited signals;

detecting variations in the first and second indicator voltages responsive respectively to the first and second switches;

energizing the selected one of the pumps for the preset time interval in response to a detected variation in at least one indicator voltage; and selecting the other pump and repeating at least the energizing step.

8. A pump control system comprising:

a first pump with a first condition indicating switch having a first state associated with the presence of said condition and a second state associated with the absence thereof;

a second pump with a second condition indicating switch having a first state associated with the presence of said condition and a second state associated with the absence thereof and wherein first and second voltage variations are produced in response to respective of said switches changing state;

first sensing circuit, associated with said first switch and second sensing circuit associated with said second switch wherein said circuits sense a said respective voltage variation as said respective switch changes state; and a control circuit, coupled to said sensing circuits and to said pumps, for energizing one or the other of said pumps for a predetermined time interval which is independent of any associated fluid level in response to said voltage variations.

9. A control system as in claim 8 wherein said control circuit includes alternator circuitry for alternately energizing one and then the other of said pumps.

10. A control system as in claim 8 wherein said sensing circuits each include at least one resistive element for providing a current limited AC feedback signal to said control circuit.

11. A control system as in claim 10 wherein said feedback signal is an AC signal.

12. A pump control system comprising:

a first pump with a first condition indicating switch having a first state associated with the presence of said condition and a second state associated with the absence thereof;

a second pump with a second condition indicating switch having a first state associated with the presence of said condition and a second state associated with the absence thereof and wherein first and second voltage variations are produced in response to respective of said switches changing state;

first sensing circuit, associated with said first switch and second sensing circuit associated with said second switch wherein said circuits sense a said respective voltage variation as said respective switch changes state; and a control circuit, coupled to said sensing circuits and to said pumps, for energizing one or the other of said pumps, for a preset time interval which is independent of any associated fluid level, in response to said voltage variations; and wherein said control circuit includes a timer for establishing said preset time interval for energizing at least one of said pumps.

* * * * *